US005411142A

United States Patent [19]

Abbott et al.

[11] Patent Number: 5,411,142

[45] Date of Patent: May 2, 1995

[54] AIR-FLOW CONTROL FOR PARTICLE CLEANING SYSTEMS

[76] Inventors: Kenneth E. Abbott, 4400 N. Bidahochi, Tucson, Ariz. 85749; Patrick J. Lyons, 1392 Via Rhonda Oriente, Tucson, Ariz. 85715; Richard M. Satariano, 4765 E. 24th St., Tucson, Ariz. 85711

[21] Appl. No.: 196,985

[22] Filed: Feb. 16, 1994

Related U.S. Application Data

[63] Continuation-in-part of Ser. No. 39,722, Mar. 29, 1993, Pat. No. 5,351,832.

[51] Int. Cl.[6] ..... B07B 9/00

[52] U.S. Cl. ..... 209/29; 209/37; 209/139.1; 209/142; 209/149

[58] Field of Search ..... 209/154, 139.1, 138, 209/140, 141, 133, 146, 149, 28, 29, 36, 37, 142

[56] References Cited

U.S. PATENT DOCUMENTS

| | | | |
|---|---|---|---|
| Re. 29,625 | 5/1978 | Summers . | |
| 409,258 | 8/1889 | Ward . | |
| 969,157 | 9/1910 | Day . | |
| 1,272,311 | 7/1918 | Plaisted . | |
| 2,330,793 | 9/1943 | Pebbles . | |
| 2,711,247 | 6/1955 | Hills | 209/29 |
| 2,931,500 | 4/1960 | Andren et al. . | |
| 2,959,284 | 11/1960 | Molstedt . | |
| 3,062,458 | 9/1957 | Dearing . | |
| 3,421,618 | 1/1969 | Burney et al. . | |
| 3,441,131 | 4/1969 | Gebauer . | |
| 3,539,008 | 11/1970 | McKibben . | |
| 3,842,978 | 10/1974 | Summers . | |
| 4,046,492 | 9/1977 | Inglis . | |
| 4,156,644 | 5/1979 | Richard . | |
| 4,176,749 | 12/1979 | Wallace et al. . | |
| 4,194,971 | 3/1980 | Beeckmans . | |
| 4,195,780 | 4/1980 | Inglis . | |
| 4,216,080 | 8/1980 | Summers et al. . | |
| 4,248,702 | 2/1981 | Wallace et al. . | |
| 4,299,694 | 11/1981 | Goodell . | |
| 4,385,728 | 5/1983 | Inglis et al. . | |
| 4,411,388 | 10/1983 | Muck . | |
| 4,521,303 | 6/1985 | Hicks et al. . | |
| 4,539,103 | 9/1985 | Hollingsworth . | |
| 4,546,552 | 10/1985 | Cahn et al. . | |
| 4,589,981 | 5/1986 | Barari et al. . | |
| 4,743,363 | 5/1988 | Darrow . | |
| 4,784,755 | 11/1988 | Taylor . | |
| 4,851,110 | 7/1989 | Rolle et al. . | |
| 4,933,072 | 6/1990 | Beisel . | |
| 5,103,981 | 4/1992 | Abbott et al. . | |
| 5,351,832 | 10/1994 | Abbott et al. | 209/139.1 |

FOREIGN PATENT DOCUMENTS

| | | |
|---|---|---|
| 0198945 | 10/1986 | European Pat. Off. . |
| 453358 | 12/1927 | Germany . |

*Primary Examiner*—David H. Bollinger

[57] ABSTRACT

An improved article separator in which the particles are separated through the use of an vertical air-flow permitting heavier particles to fall while entraining the lighter particles and storing them in a hopper. The air flow is automatically controlled using a microprocessor or similar apparatus which checks the air-flow/speed within the vertical channel or tubing. Using this data, the controller adjusts a dampener at the end of the channel. The dampener, restricts the flow of air through it so that the overall air-flow within the channel is adjusted. Using a dust collector to create the air-flow, a plurality of vertical columns are used to separate varying sizes of particles. In this manner, the debris is simply swept or shoveled into a hopper and the particles are automatically separated.

32 Claims, 5 Drawing Sheets

| MESH RANGE | VELOCITY SETTING FPM |
|---|---|
| 20 - 25 | 300 - 350 |
| 25 - 38 | 225 - 275 |
| 38 - 50 | 100 - 150 |

FIG. 5

AIR-FLOW CONTROL FOR PARTICLE CLEANING SYSTEMS

This is a continuation-in-part of U.S. patent application Ser. No. 08/039,722, filed Mar. 29, 1993, now U.S. Pat. No. 5,351,832 and entitled "Control System For Cleaning Systems".

BACKGROUND OF THE INVENTION

This invention relates generally to particle cleaning and separating and more specifically, this invention relates to precision monitoring and control of particle cleaning and separating machines which separate particles based upon the relative densities or weights of the particles.

The separation of a useful product from an unusable item has plagued man almost from the dawn of time. In fact, the early form of threshing wheat, using the wind to blow away the chaff, is one such solution to the problem.

As the industrialization of the world took place, the separation of particles became a more intense problem since the materials sought were needed in higher concentrations than before.

Separating a fluid mixture has posed some very unique problems. With these problems, some unique solutions have been developed such as U.S. Pat. No. 4,539,103, entitled "Hydraulic Separating Method and Apparatus" issued Sep. 3, 1985, to Hollingworth; and U.S. Pat. No. 4,176,749, entitled "Materials Separation" issued Dec. 4, 1979, to Wallace et al. In both of these inventions, the material that is to be separated is suspended in a liquid which is utilized for the extraction of the material.

Unfortunately, the abilities and expertise of liquid separators are not easily ported over to a mixture of dry material.

In attempting to solve this problem, a wide variety of fluidized beds have been developed including: U.S. Pat. No. 4,194,971, entitled "Method of Sorting Fluidized Particulate Material and Apparatus Therefor" issued Mar. 25, 1980, to Beeckmans; and U.S. Pat. No. 4,546,552, entitled "Fluid Induced Transverse Flow Magnetically Stabilized Fluidized Bed" issued Oct. 15, 1985, to Cahn et al.

In all fluidized bed separation situations, the mixture to be separated is suspended on a grate or bed while air "bubbles" through the mixture at a rate sufficient to remove a targeted particle permitting the remaining material to be swept away or to fall through the grate. Balancing the inflow of contaminated mixture to the throughput is extremely difficult. Without this control though, the mechanism does not perform optimally.

The problem of control is of such a concern that a whole group of inventions address this problem alone. One such invention is described in U.S. Pat. No. 4,248,702, entitled "Stratifier Discharge Control" issued Feb. 3, 1981, to Wallace et al.

Even though the fluidized bed concept is complex, it is far from optimal and a wide range of enhancements have been developed such as U.S. Pat. No. 4,156,644, entitled "Pulsating Sludge Bed with Inclined Plates" issued May 29, 1979, to Richard.

As the complexity of the devices have grown, so too has the down time and repair costs. To attempt to simplify the situation, some devices have attempted to revert to the simpler modes of operation, or have attempted to solve the problem in unique ways. This includes U.S. Pat. No. 4,589,981, entitled "Fluidized Bed Classifier" issued May 20, 1986, to Barari et al. and U.S. Pat. No. 4,521,303, entitled "Solids Separation in Self-Circulating magnetically Stabilized Fluidized Bed" issued Jun. 4, 1985, to Hicks et al.

In all of these apparatuses, the mechanism becomes more and more expensive to operate and acquire. This makes them less than ideal for many situations.

Perhaps the most illustrative of the techniques currently used are the ones developed to separate tobacco leaves and parts from sand. These include: U.S. Pat. No. 4,216,080, entitled "Method and Apparatus for Separating Sand from Botanical Fines" issued Aug. 5, 1980, to Summers et al.; and, U.S. Pat. No. 3,842,978 entitled "Process and Apparatus for Separating Sand from Botanical Materials" issued Oct. 22, 1974, to Summers.

In these inventions, the contaminated mixture (tobacco fines and sand) is dropped into a fluidized bed arrangement where it is supported by a grate. Air is drawn through the grate which causes the contaminated mixture to "bubble". The heavier sand falls through the grate. The bubbling action pulls a partially cleaned mixture of sand and fines up to a cyclone separator which performs a final cleaning of the mixture.

The final cleaning by the cyclone separator is necessary since it is this cyclone separator which provides the air draft to "suck" the partially cleaned mixture from the fluidized bed.

In these inventions, the use of the fluidized bed is required since the contaminated mixture must have a certain amount of dwell time within the separating mechanism. The dwell time within the bed is necessitated by the very nature of the cyclone separator which is extremely sensitive to many factors including the feed and exhaust tubing arrangement, physical damage to the input and exhaust ports, motor speed, variations in power source, etc.

A recent and more cost effective particle separation device is illustrated by U.S. Pat. No. 5,103,981 entitled "Particle Separator/Classification Mechanism" issued Apr. 14, 1992, to Abbott et al. This device separates particles using airflow to entrain and carry away lighter particles while heavier particles fall away. The entraining airflow is induced using an airflow amplifier powered by pressurized gas. While this separation device works well, it does not achieve complete separation of particles under all conditions.

It is clear from the foregoing that except for the expensive and delicate fluidized bed arrangements, an efficient inexpensive solution to the separation of particles which operates under all conditions does not exist.

SUMMARY OF INVENTION

The invention is an improved particle separator in which the particles are separated through the use of an vertical air-flow permitting heavier particles to fall while entraining the lighter particles and storing them in a hopper.

The air flow is automatically controlled using a microprocessor or similar apparatus which checks the air-flow/speed within the vertical channel or tubing. Using this data, the controller adjusts a dampener at the end of the channel. The dampener restricts the flow of air through it so that the overall air-flow within the channel is adjusted.

A dust collector is the means for creating the air-flow. A plurality of vertical columns are used to separate varying sizes of particles. In this manner, the debris is simply swept or shoveled into a hopper and the particles are automatically separated.

The invention creates a system for cleaning or separating particles that uses a controller or computer to precisely control the cleaning or separating process. By carefully monitoring and controlling the separating process, an improved degree of separation is achieved.

In the preferred embodiment, the invention controls a particle separating machine which uses upward airflow in a channel to separate less dense particles from heavier or more dense particles. One such particle separator machine is described in U.S. Pat. No. 5,103,981 entitled "Particle Separator/Classification Mechanism" issued Apr. 14, 1992, to Abbott et al., incorporated hereinto by reference.

Upward airflow is induced in the channel by an airflow means. A wind speed sensor measures the air velocity in the channel and communicates this data to a controller. An operator inputs targeted or desired upward air velocity to the controller.

The controller commands the airflow means to increase or decrease airflow in the channel so that upward air velocity in the channel remains comparable to the targeted upward air velocity input from the operator. Particles entering the channel are separated to a very high accuracy because of the precisely controlled airflow.

The first significant feature of the invention is the controller. The controller continuously monitors and controls the particle separation machine so that optimum separation efficiency is achieved.

The controller receives data indicative of the actual air velocity in the channel. The controller then commands the airflow means to increase or decrease airflow in the channel to maintain the target air velocity in the channel.

A wind speed sensor measures air velocity in the channel. The wind speed sensor generates an air velocity signal indicative of the actual air velocity in the channel and communicates this signal to the controller. The controller uses this air velocity signal to determine if airflow in the channel needs to be increased or decreased.

Airflow in the channel is induced by an airflow means. In the preferred embodiment the airflow means is an airflow amplifier. Airflow amplifiers are devices which induce airflow by directing pressurized gas through a channel at high velocity. The high velocity pressurized gas moving through the channel induces an increased volume of air to move through the channel. Airflow amplifiers have no moving parts and are powered only by pressurized gas. Airflow amplifiers are precisely controlled by merely controlling the supply of pressurized gas to the airflow amplifier. Airflow amplifiers are described in detail below.

A gas pressure valve controls the supply of pressurized gas to the airflow amplifier. Gas pressure valves are commonly known in the art. Increasing the supply of pressurized gas to the airflow amplifier increases the power of the airflow amplifier and consequently increases airflow and air velocity in the channel. Similarly, decreasing the supply of pressurized gas to the airflow amplifier decreases the power of the airflow amplifier and consequently decreases airflow and air velocity in the channel.

A transducer enables the controller to control the gas pressure valve. Transducers are commonly known in the art. The transducer converts electrical signals from the controller into a correlated gas pressure. The correlated gas pressure in turn controls the gas pressure valve.

The preferred embodiment of the gas pressure valve and transducer are described in detail below.

The wind speed sensor, controller, transducer, gas pressure valve, and airflow amplifier comprise the principal components of the preferred embodiment of the invention. These components function together to precisely control air velocity in the channel.

The current invention allows particle separation machines to be significantly more efficient. There are several reasons for this increased efficiency. First, the invention allows the air velocity in a channel to be adjusted nearly instantaneously when the channel is totally or partially blocked. For example, when large amounts of particles are deposited into a channel at the same time, air velocity in the channel normally decreases because of the blockage. Consequently, the particles are not efficiently nor completely separated. The invention, however, quickly detects a decrease in air velocity and makes nearly instantaneous adjustments to increase the air velocity in the channel to the targeted velocity. Thus, the invention allows the particle separation machine to continue to efficiently separate particles even when large amounts of particles are placed in the channel.

Secondly, the invention allows the air velocity in the channel to be maintained when variations in the pressurized gas supply occur. Variations in the pressurized gas supply are common due to other loads on the pressurized gas and varying demands for the pressurized gas. Without the invention, variations or changes in the pressurized gas supply cause related variations in the airflow and air velocity in the channel. Any variations in the air velocity from the target air velocity cause the particle separation machine to be less efficient than possible.

The invention compensates nearly instantaneously for any variations in the pressurized gas supply. The invention quickly detects a reduced air velocity in the channel and makes nearly instantaneous adjustments to increase the air velocity in the channel. Similarly, the invention quickly detects an increased air velocity in the channel and makes nearly instantaneous adjustments to decrease the air velocity in the channel.

The preferred embodiment adjusts the air-flow within the vertical channels or tubing using an automatically controlled dampener. The dampener is preferably positioned above the clean media hopper (where the air-flow is downward) and is used to restrict the flow of air through the channel. In this manner, the "feed" of air to a dust collector blower is controlled resulting in a highly controlled air-flow within the vertical channel.

In this preferred embodiment, a single motor, normally associated with the dust collector, provides the entire air-flow requirements. This motor works at a constant speed and the amount of air which is exhausted from the dust collector is controlled exclusively by the dampener(s).

If a plurality of channels are used, the dust collector blower should have sufficient capacity to exhaust more than the sum of all of the air-flows from the channels when the dampeners are wide open. This assures that full control by the computer is always available.

Because all of the air through the channels is also passed through a dust collector, dust problems associated with the media are virtually eliminated.

The current invention makes particle separation machines significantly more efficient. The significant features of the invention are illustrated in the figures and described more fully below.

BRIEF DESCRIPTION OF THE DRAWINGS

FIG. 5 is a chart of best air velocities for separating certain particles.

DETAILED DESCRIPTION OF THE DRAWINGS

Figure 1:
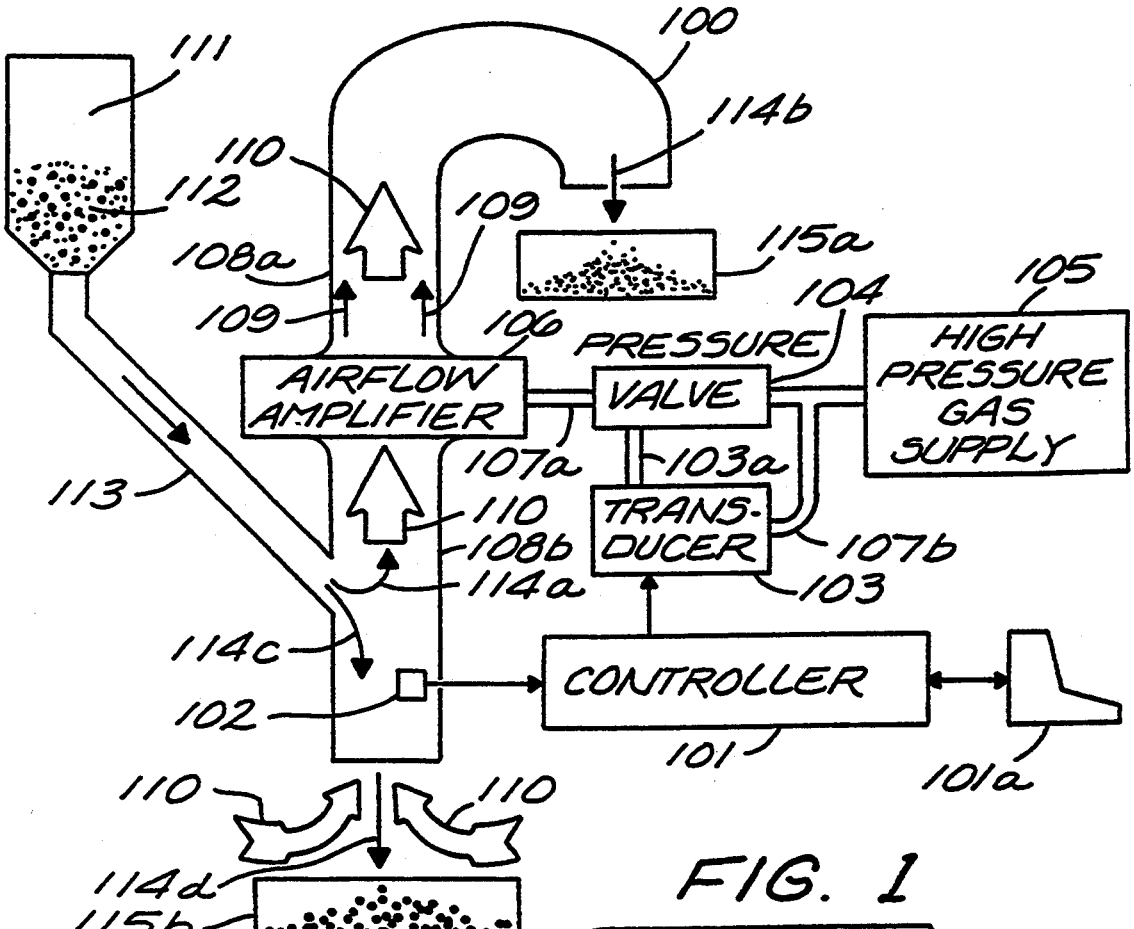
FIG. 1 shows the preferred embodiment of the invention controlling an airflow type particle separation machine.

FIG. 1 shows the preferred embodiment of the invention controlling an airflow type particle separation machine. Particle separation machine 100 is connected to controller 101, wind speed sensor 102, transducer 103, and pressure valve 104.

High pressure gas supply 105 supplies pressurized gas to particle separation machine 100. High pressure gas supply 105 is any type of pressurized gas supply capable of supplying a continuous supply of pressurized gas. High pressure gas supplies are commonly known in the art and include, but are not limited to, electric powered air compressors, gas engine powered air compressors, pressurized gas tanks, and the like.

The pressurized gas is any kind of gas suitable for this purpose including, but not limited to, air, oxygen, nitrogen, and the like.

Pressure valve 104 regulates the supply of pressurized gas from high pressure gas supply 105 to airflow amplifier 106. Pressure valves (sometimes referred to as pilot operated regulators) are commonly known in the art. A variety of suitable pressure valves are commonly available.

Pressurized gas is supplied to airflow amplifier 106 via gas supply line 107*a*. Airflow amplifier 106 directs the pressurized gas upward into channel 108*a* at high speed as shown by arrows 109. The pressurized gas flow induces airflow through channel 108*b* as shown by arrows 110.

Airflow amplifiers are well known in the art. Some examples are: U.S. Pat. No. 4,046,492, entitled "Air Flow Amplifier" issued Sep. 6, 1977, to Inglis; U.S. Pat. No. 4,385,728, entitled "Flow-Amplifying Nozzle" issued May 3, 1983, to Inglis et al.; and U.S. Pat. No. 4,195,780, entitled "Flow Amplifying Nozzle" issued Apr. 1, 1980, to Inglis (all of which are incorporated hereinto by reference). Commercially, airflow amplifiers of relatively high amplification ratio are available from Vortec Corporation and are referred to as "transvectors".

The key to an airflow amplifier is that it utilizes air or gas under high pressure. An airflow amplifier directs the high pressure air through an air channel in the direction of the desired airflow. As the high pressure air moves through the air channel, it naturally sucks or draws the heretofore static or ambient air along with it. This movement of air induces airflow in the air channel.

Because the resulting airflow is established by use of a relatively small amount of high pressure air, an air compressor easily establishes a source of high pressure air to operate the airflow amplifier without moving parts. Equivalent airflow means are commonly known in the art and include, but are not limited to, various types of fans, blowers, vacuums, and the like.

Air channel 108 is comprised of an upper channel 108*a*, which is above airflow amplifier 106, and a lower channel 108*b*, which is below airflow amplifier 106.

A feature of the preferred embodiment is that the upper channel 108*a* has a smaller diameter than the lower channel 108*b*. This feature causes a higher air velocity in the upper channel 108*a* and aids in transporting the light weight separated particles to container 115*a*. In the preferred embodiment, used for cleaning abrasive blasting media, upper channel 108*a* is six inches in diameter and lower channel 108*b* is seven inches in diameter.

Hopper 111 holds particles or media 112 to be separated. Particles or media 112 are transported to channel 108*b* by tube 113. As the particles enter the lower channel 108*b* they encounter upward airflow. Lighter or less dense particles are entrained by the upward airflow and move upward as shown by arrow 114*a*. The lighter or less dense particles are conveyed by the airflow up channel 108*a* and deposited into container 115*a*.

Heavier or more dense particles are not entrained by the airflow and drop out the bottom of channel 108*b* as shown by arrows 114*c* and 114*d*. These particles fall into container 115*b*.

Wind speed sensor 102 detects air velocity in the lower portion of channel 108*b*. Wind speed sensor 102 generates an air velocity signal indicative of the actual air velocity or wind speed in channel 108*b*. This air velocity signal is communicated to controller 101.

Wind speed sensors are commonly known in the art. Wind speed sensor 102 is any wind speed sensor capable of accurately measuring air velocity and generating a suitable air velocity signal. The preferred embodiment uses a Series 640 Air Velocity Transmitter manufactured by Dwyer Instruments, Inc., of Michigan City, Ind.

Controller 101 receives the air velocity signal from wind speed sensor 102. Controller 101 also receives operator inputs from operator interface 101*a*. The controller is a computer, microprocessor, microcontroller, electronic circuit, or the like with the necessary capabilities to perform control functions. Operator interface 101*a* is any suitable interface for receiving operator inputs, including, but not limited to, keyboards, consoles, control panels, data terminals, switches, and the like.

The preferred embodiment uses a series 1600 Temperature/Process Control device manufactured by Dwyer Instruments, Inc., of Michigan City, Ind., to handle the combined functions of the controller 101 and the operator interface 101*a*.

Controller 101 receives targeted air velocity data from operator interface 101*a*. Controller 101 compares the air velocity signal from wind speed sensor 102 with the targeted air velocity data from operator interface 101*a*. If the air velocity signal and the targeted air velocity data are not equal, controller 101 commands transducer 103 and pressure valve 104 to increase or decrease gas pressure as needed to return air velocity to the targeted velocity.

Controller 101 sends commands to transducer 103. Transducer 103 converts the controller's command into gas pressure. Transducer 103 is supplied with pressurized gas via gas supply line 107*b*. Transducer 103 communicates commands to pressure valve 104 via gas line 103*a*.

Pressure valve 104 and transducer 103 are described in detail below.

Figure 2:
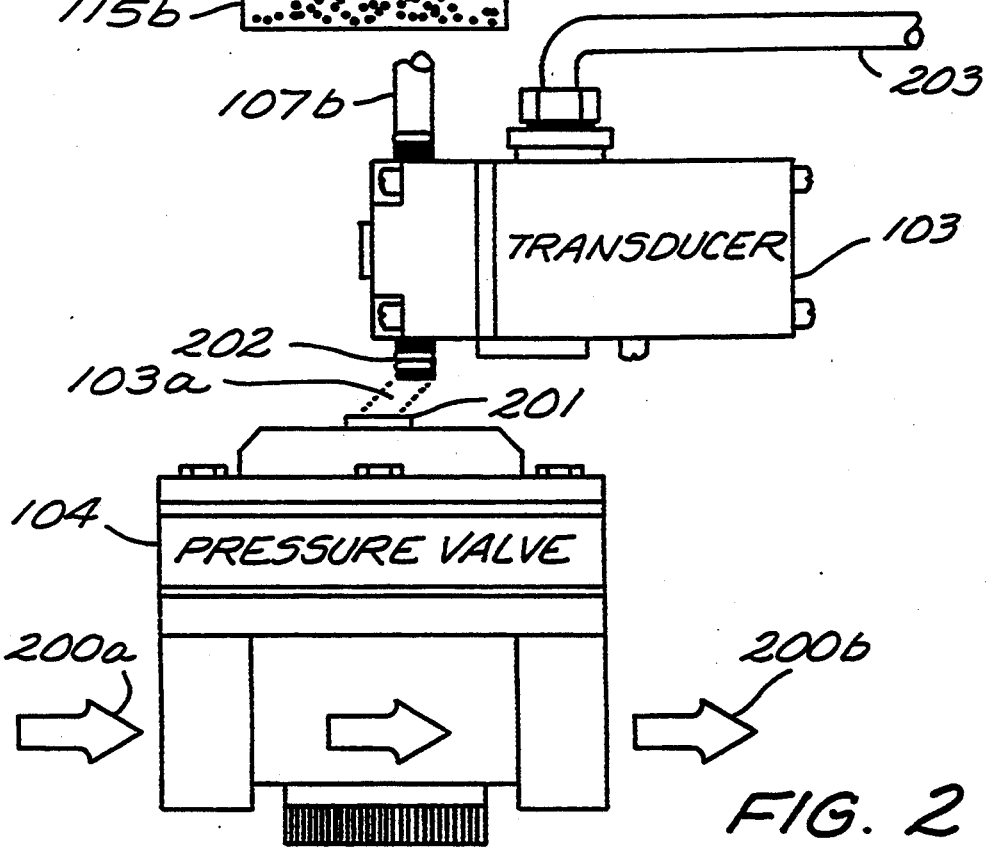
FIG. 2 shows the gas pressure valve and transducer assembly in detail.

FIG. 2 shows pressure valve 104 and transducer 103 in detail.

Pressure valve 104 regulates the supply of pressurized gas to the airflow amplifier (not shown). Pressure valve 104 (sometimes referred to as pilot operated regulators) are commonly known in the art. Pressurized gas enters pressure valve 104 as shown by arrow 200*a*. Regulated pressurized gas exits pressure valve 104 as shown by arrow 200*b*.

Pressure valve 104 is controlled via control port 201. Transducer output port 202 attaches to or is in communication with control port 201 via gas line 103*a*. Transducer 103 converts electrical signals from controller (not shown) into gas pressure by which pressure valve 104 is controlled. Cable 203 communicates pressure command signals from controller to transducer 103.

Transducer 103 is supplied with pressurized gas from high pressure gas supply (not shown). Pressurized gas is supplied to transducer 103 via gas supply line 107*b*.

Electrical to gas pressure transducers are commonly known in the art. The preferred embodiment, uses a Type 1000 Transducer produced by Bellofram of Newell, W.Va.

Figure 3:
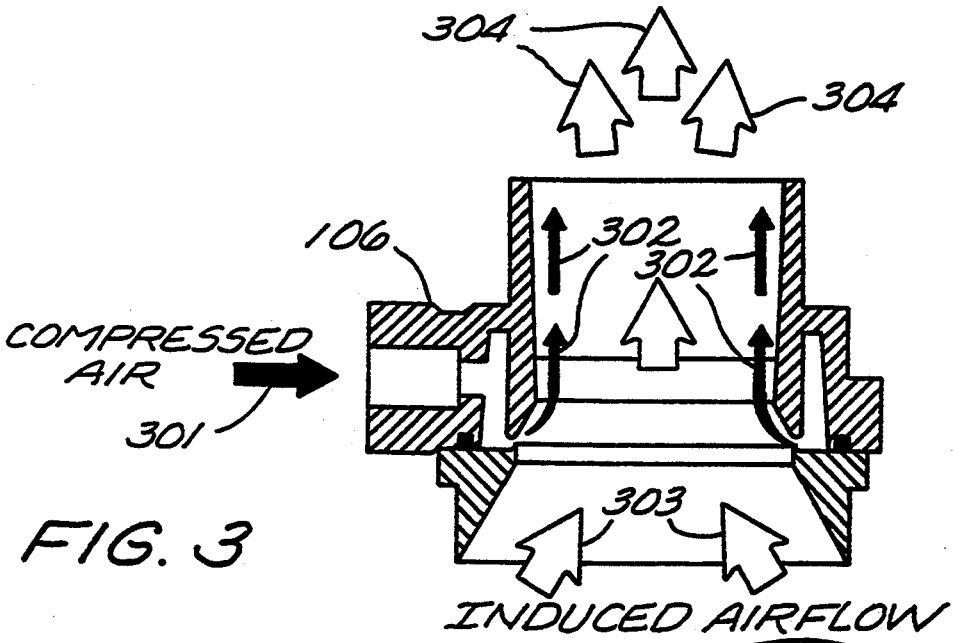
FIG. 3 shows a cutaway view of an airflow amplifier.

FIG. 3 shows an airflow amplifier 106 in detail. Compressed air 301 is supplied to the airflow amplifier 106. Arrows 302 represent compressed air directed through airflow amplifier 106. The compressed air "induces" the flow of a greater volume of air through airflow amplifier 106. Arrows 303 represent the induced airflow into the airflow amplifier 106. Arrows 304 represent the combined airflow of both the induced airflow 303 and the compressed airflow 302 leaving the airflow amplifier 106. The airflow amplifier 106 thus induces airflow as a fan would, but without any moving parts.

Figure 4:
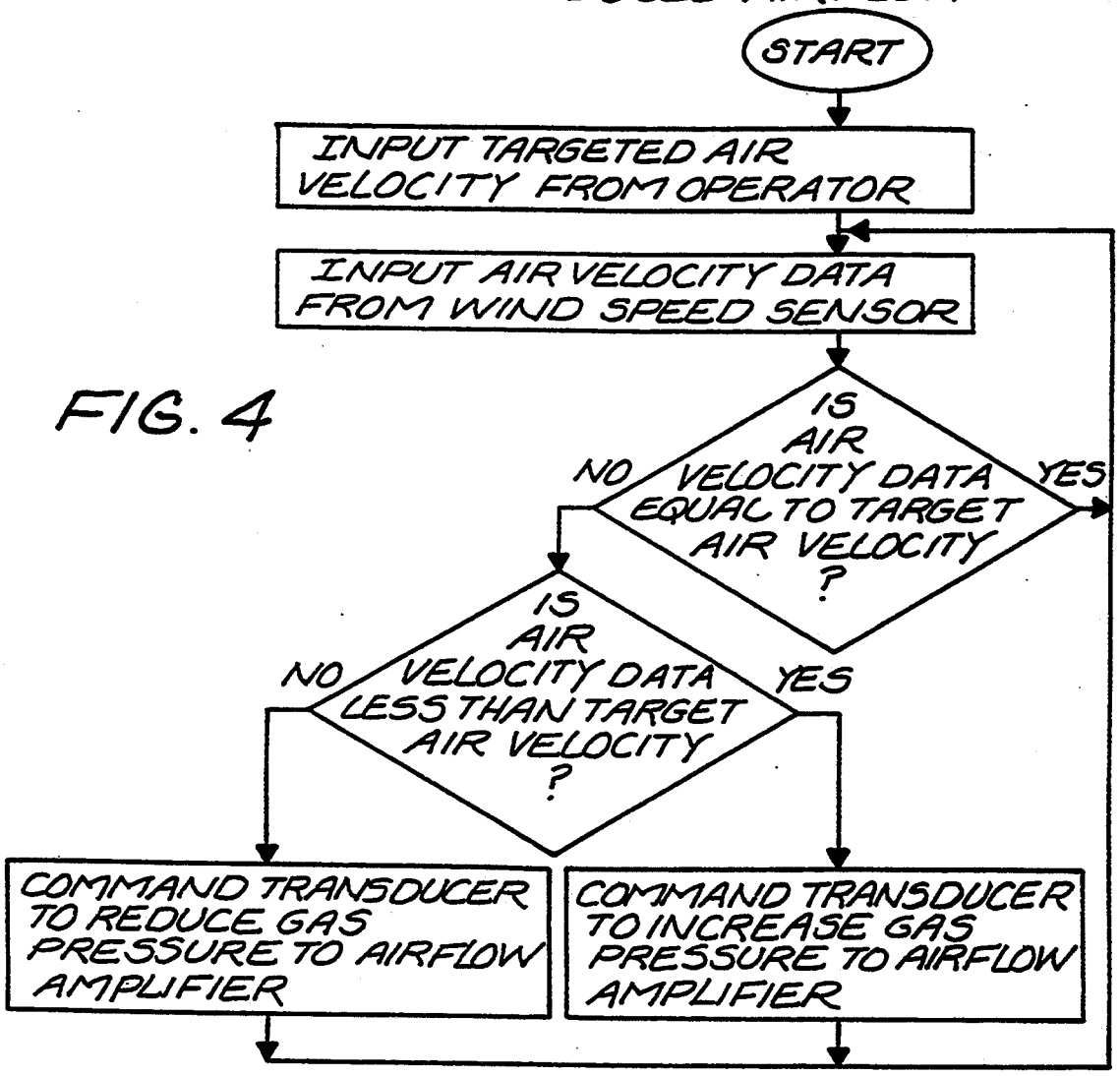
FIG. 4 shows a flowchart for the program in the controller.

FIG. 4 is a flowchart of a computer control program for the invention. This flowchart is a simplified flowchart demonstrating one implementation of a computer program for the invention. Those of ordinary skill in the art readily recognize equivalent flowcharts which perform substantially the same functions in substantially the same way.

Controller begins by receiving targeted wind speed or air velocity data from the operator. The flowchart then enters a repetitive loop which is a feedback control loop.

Next, the controller receives air velocity data from the wind speed sensor. The air velocity data is compared to the targeted air velocity data. If they are equal the flowchart loops back up to receive new air velocity data from the wind speed sensor.

If they are not equal then the air velocity data is tested to find whether it is less than the targeted air velocity. If it is less than the targeted air velocity the controller commands the transducer to increase gas pressure to the airflow amplifier.

Similarly, if it is greater than the targeted air velocity the controller commands the transducer to decrease gas pressure to the airflow amplifier.

The flowchart then loops back to receive new air velocity data from the wind speed sensor. This loop is continuously repeated to constantly monitor and control air velocity in the channel.

FIG. 5 is a chart of the best air velocities for separating certain size particles.

The best information currently available specifies an initial range of air velocities for separating certain size particles. The chart specifies particles according to mesh size and air velocity in feet per minute (FPM).

Larger particles, in the 20 to 25 mesh size, require higher air velocity to be entrained and separated by the upward air flow. Smaller particles, in the 38 to 50 mesh size, require lower air velocity to be entrained and separated by the upward air flow.

An operator uses the chart for the initial setting of air velocity. The operator then makes fine adjustments to the air velocity to achieve the desired separation of particles.

This specification describes the preferred embodiment of the invention. Those of ordinary skill in the art recognize equivalent embodiments which perform substantially the same function, in substantially the same way, to accomplish substantially the same result.

Figure 6:
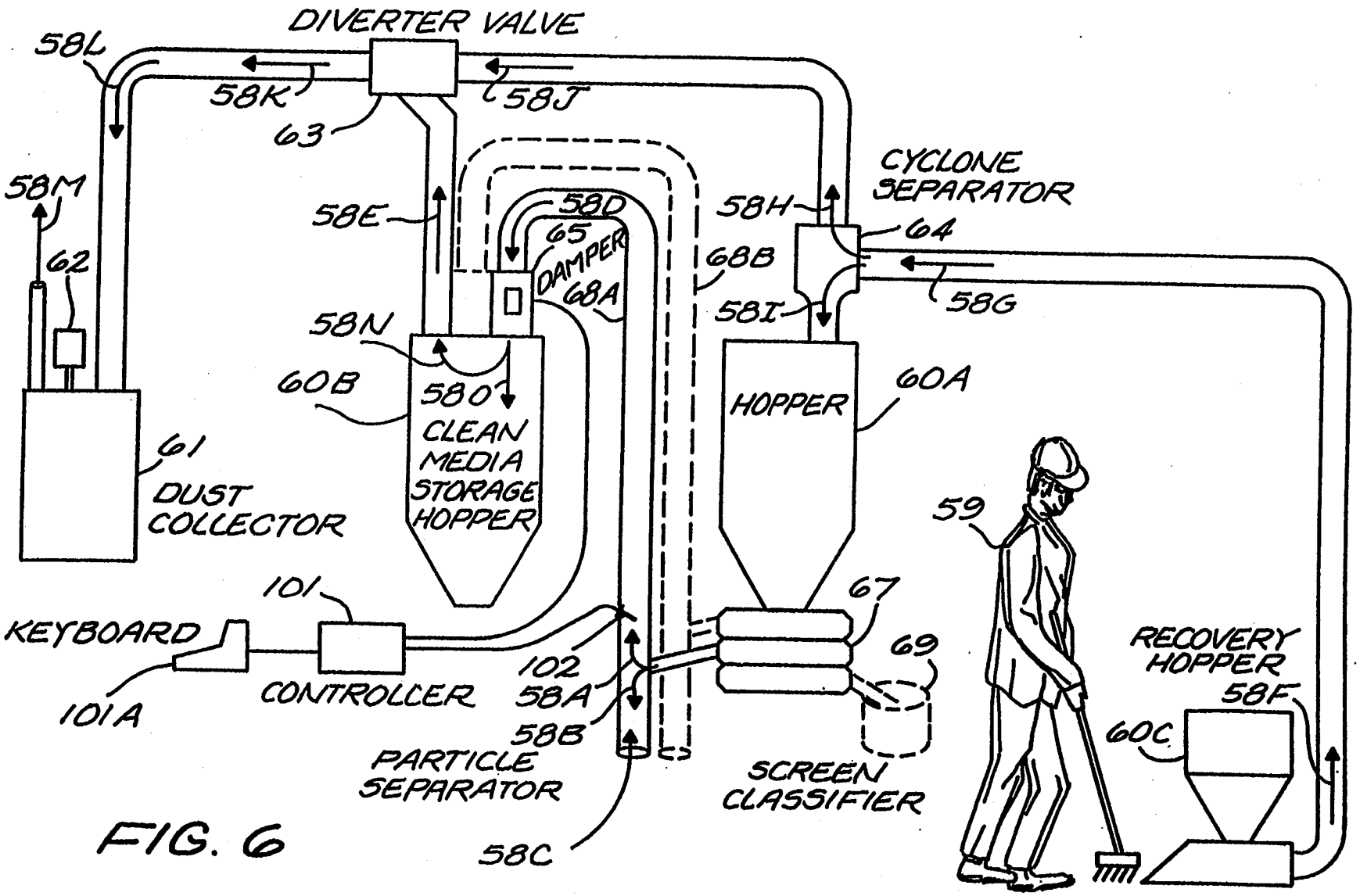
FIG. 6 is a layout illustration of the preferred embodiment.

FIG. 6 is a layout illustration of the preferred embodiment.

The main components of this preferred embodiment is the vertical channel or tube 68A, damper 65, and fan 62. Fan 62 causes an air-flow which exhaust as shown by arrow 58M. This air-flow results in air being drawn as shown by arrows 58L, 58K, 58E, 58N, through damper 65. Damper 65 acts as a variable resistance to the flow of air from the vertical channel 68A. As discussed earlier, through control of the air-flow, as shown by arrow 58D, heavier particles drop into the channel 68A, fall (as shown by arrow 58B) while lighter particles rise (as shown by arrow 58A). The source of the air is through the bottom of channel 68A as shown by arrow 58C.

The rising particles, as shown by arrow 58A, pass along, as shown by arrow 58D, via a connecting tubing into the clean media storage hopper 60B and are collected there (arrow 580) while dust is drawn along (arrow 58N) toward diverter valve 63 (as shown by arrow 58E) and eventually to dust collector 61.

Diverter valve 63 assists in loading the "dirty" mixture of particles into hopper 60A. In this operation, diverter valve 63 is changed so that air is drawn as shown by arrow 58J. Dirty media is swept or shoveled by operator 59 into recovery hopper 60C which draws the dirty mixture, as shown by arrow 58F and 58G, into cyclone separator 64 where dust is drawn away (arrow 58H) while the particle mixture falls into hopper 60A (arrow 58I).

Once the dirty mixture has been collected in hopper 60A, diverter valve 63 is switched to draw air as shown by arrow 58E.

The dirty mixture from hopper 60A falls through a shaking screen classifier 67 which separates the mixture into size groups and communicates the mixtures to the appropriate vertical channel (either 68A or 68B in this example). Trash is collected in receptacle 69.

Computer/controller 101 receives directions from keyboard 101A which establishes the operator desired flow-rate for the vertical channels 68A and 68B. For ease in illustration, only the interconnection and control for channel 68A is shown.

Wind speed monitor 102 generates a data signal used by controller 101 to adjust damper 65 in the modulation of the air-flow within the vertical channel 68A. In this manner, the exact desired air-flow is maintained so that proper separation of the particles is achieved.

Should multiple channels be used, e.g. 68A and 68B, then the single computer, or individual controllers are utilized to control the process in the channels. In the preferred embodiment, the cleaned particles are all deposited into the single media storage hopper 60B and all of the dampers (only damper 65 shown in this illustration) are located on the top of hopper 60B.

Figure 7:
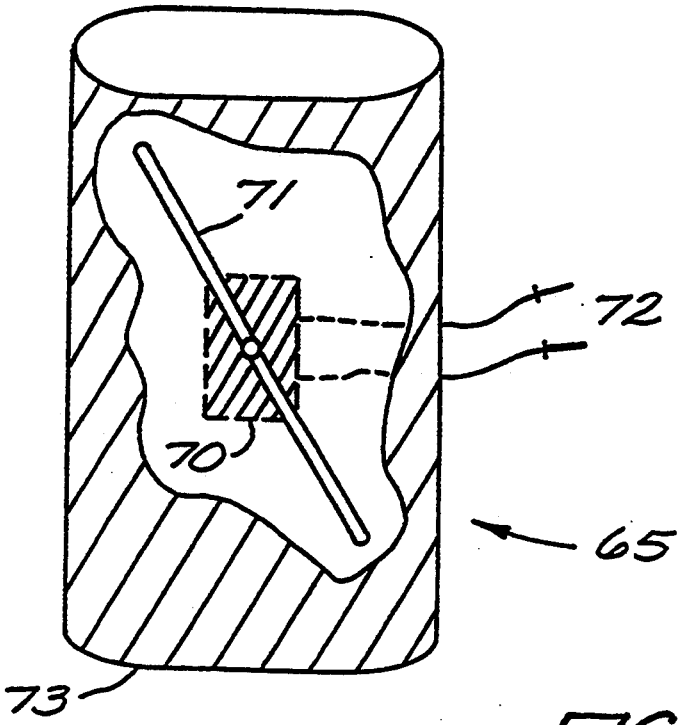
FIG. 7 is a cutaway view of the preferred dampener.

FIG. 7 is a cutaway view of the preferred dampener. Dampener 65 consists of a hollow tubing 73 with damper blade 71 pivotally located therein. Motor 70 is used to adjust the position of damper blade 71 and responds to signals received via connection 72.

In the preferred embodiment, damper 65 seals to input and output tubes so that an air-tight fit is achieved.

Figure 8:
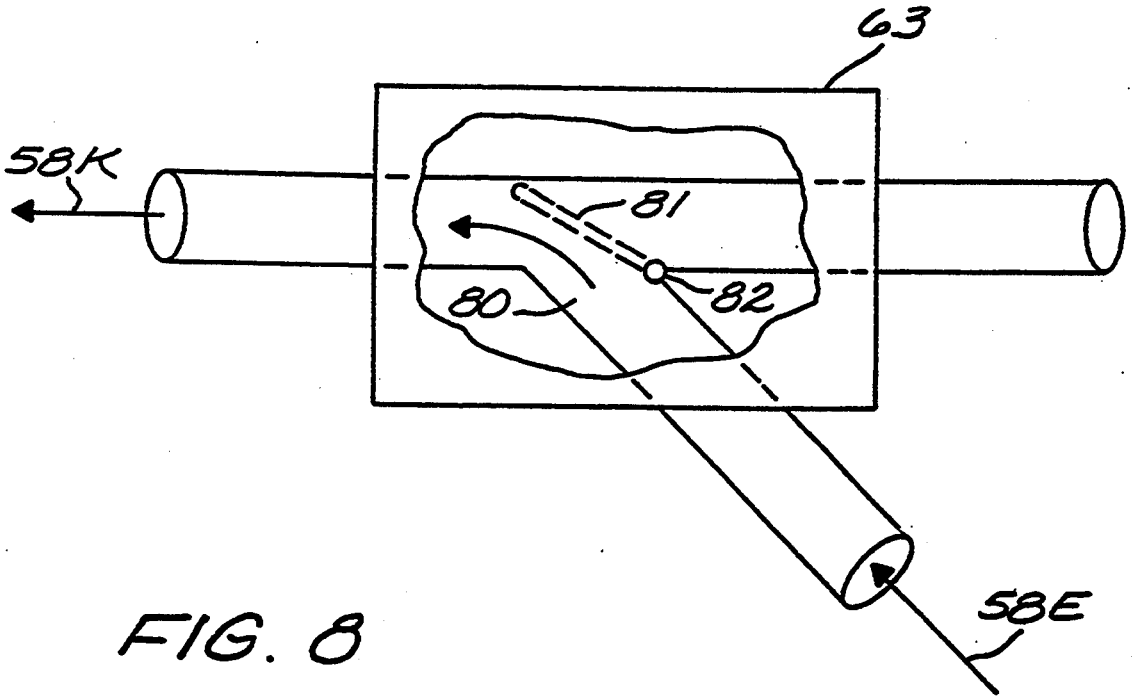
FIG. 8 is a cutaway view of the preferred diverter valve first illustrated in FIG. 6.

FIG. 8 is a cutaway view of the preferred diverter valve first illustrated in FIG. 6.

The diverter 63 is used in the preferred embodiment to change the direction of suction from the motor 62 (FIG. 6). Diverter 63 is essentially a "Y" of tubes having a valve 81 at the intersection. A motor, not shown, pivots valve 81 so that air drawn as shown by arrow 58K is from either one branch or the other branch of the "Y". In this illustration, valve 81 has closed one of the branches and permits air to be drawn as shown by arrow 58E.

It is clear from the foregoing that the present invention represents a new and useful device for improving the performance of air powered particle separation machines.

What is claimed is:

1. A mechanism to separate particles based upon their mass comprising:

a) a substantially vertical first channel;

b) air-flow means for creating an upward air-flow in said vertical first channel, said air-flow means operating at a constant speed;

c) a first wind speed means for determining air-flow rates and generating flow data indicative of air-flow, said first wind speed means being positioned in said vertical first channel;

d) a first means for depositing particles into said vertical first channel;

e) dampening means for restricting air-flow between said vertical first channel and said air-flow means such that heavier particles fall in said upward air-flow caused in said vertical first channel while lighter particles are entrained in said air-flow; and, f) control means communicating with said first wind speed means and said dampening means, said control means for adjusting said dampening means based upon said flow data from said wind speed means.

2. The mechanism according to claim 1 further including an operator input apparatus for operator entry of desired air-flow data indicative of a desired air-flow in said vertical first channel, and wherein said control means includes means for adjusting said dampening means such that the flow data is proximate to the desired air-flow data.

3. The mechanism according to claim 2 further including:

a) a first hopper; and, b) a first tubing means for communicating particles from said vertical first channel to said first hopper.

4. The mechanism according to claim 3 wherein said dampening means is positioned between said hopper and said first tubing means.

5. The mechanism according to claim 4 wherein said air-flow means is in operative communication with said first hopper such that said air-flow means causes air to be drawn through said vertical first channel.

6. The mechanism according to claim 5 further including a dust collecting mechanism in operative communication with said air-flow means such that said air-flow means draws air through said dust collecting mechanism.

7. The mechanism according to claim 5 wherein air-flow within said dampening means is substantially downward.

8. The mechanism according to claim 7 further including means for classifying said particles based upon size and wherein said means for classifying communicates a first size particle to said first means for depositing particles.

9. The mechanism according to claim 8 further including a floor recovery hopper communicating particles to said means for classifying.

10. The mechanism according to claim 9 further including a second hopper means for containing particles from said floor recovery hopper prior to communication to said means for classifying.

11. The mechanism according to claim 10 further including:

a) a substantially vertical second channel;

b) a second means for depositing particles from said means for classifying into said second vertical channel;

c) a second tubing means communicating between said second vertical channel and said first hopper; and, d) a second dampening means for restricting air-flow between said second tubing means and said first hopper.

12. A mechanism to separate particles comprising:

a) a substantially vertical channel;

b) air-flow means for creating an upward air-flow in said vertical channel, said air-flow means operating at a constant speed;

c) means for depositing particles into said vertical channel;

d) means for restricting air-flow between said vertical channel and said air-flow means;

e) wind speed means for determining air-flow rates in said vertical channel and generating flow data indicative thereof; and, f) control means communicating with said wind speed means and said means for restricting, said control means for adjusting said means for restricting based upon said flow data from said wind speed means.

13. The mechanism according to claim 12 further including an operator input apparatus for operator entry of desired air-flow data indicative of a desired air-flow in said vertical channel and wherein said control means includes means for adjusting said means for restricting such that said flow data is proximate to said desired air-flow data.

14. The mechanism according to claim 13 further including:

a) a first hopper; and, b) tubing means for communicating particles from said vertical first channel to said first hopper.

15. The mechanism according to claim 14 wherein said means for restricting air-flow is positioned between said hopper and said tubing means.

16. The mechanism according to claim 15 wherein said air-flow means is in operative communication with said first hopper such that said air-flow means causes air to be drawn through said vertical first channel.

17. The mechanism according to claim 16 further including a dust collecting mechanism in operative communication with said air-flow means such that said air-flow means draws air through said dust collecting mechanism.

18. The mechanism according to claim 15 wherein air-flow within said means for restricting is substantially downward.

19. The mechanism according to claim 18 further including means for classifying said particles based upon size and wherein said means for classifying communicates a first size particle to said means for depositing particles.

20. The mechanism according to claim 19 further including a floor recovery hopper communicating particles to said means for classifying.

21. The mechanism according to claim 20 further including a second hopper means for containing particles from said floor recovery hopper prior to communication to said means for classifying.

22. The mechanism according to claim 21 further including:

a) a substantially vertical second channel;

b) a second means for depositing particles from said means for classifying into said second channel;

c) a second tubing means communicating between said second vertical channel and said first hopper; and, d) a second means for restricting airflow between said second tubing means and said first hopper.

23. A mechanism to separate particles based upon their mass comprising:

a) a single air-flow means for creating an air-flow and operating at a constant speed;

b) N substantially vertical channels;

c) N wind speed means for determining air-flow rates and generating flow data indicative of air-flow, each of said wind speed means being positioned in one of said vertical channels;

d) N means for depositing particles into a channel, each means for depositing communicating with one of said channels;

e) N dampening means for restricting air-flow, each dampening means positioned between said vertical channel and said air-flow means;

f) control means communicating with each of said wind speed means and each of said dampening means, for adjusting said dampening means of each of said N vertical channels based upon said flow data from the wind speed means of the specific vertical channel.

24. The mechanism according to claim 23 further including an operator input apparatus for operator entry of desired air-flow data indicative of a desired air-flow in each of said vertical channels and wherein said control means includes means for adjusting said dampening means in each of said N vertical channels such that said flow data for that vertical channel is proximate to the desired air-flow data for that vertical channel.

25. The mechanism according to claim 24 further including:

a) a first hopper; and, b) N tubing means, each of said tubing means associated with one of said vertical channels, for communicating particles from said vertical channel to said first hopper.

26. The mechanism according to claim 25 wherein each of said dampening means is positioned between said hopper and one of said tubing means.

27. The mechanism according to claim 26 wherein said air-flow means is in operative communication with said first hopper such that said air-flow means causes air to be drawn through each of said channels.

28. The mechanism according to claim 27 further including a dust collecting mechanism in operative communication with said air-flow means such that said air-flow means draws air through said dust collecting mechanism.

29. The mechanism according to claim 27 wherein air-flow within each of said dampening means is substantially downward.

30. The mechanism according to claim 29 further including means for classifying said particles based upon size and wherein said means for classifying communicates a single particle size to one of said means for depositing particles.

31. The mechanism according to claim 30 further including a floor recovery hopper communicating particle to said means for classifying,

32. The mechanism according to claim 31 further including a second hopper means for containing particles from said floor recovery hopper prior to communication to said means for classifying.

* * * * *